US010297237B2

(12) United States Patent
Canivell Grifols

(10) Patent No.: US 10,297,237 B2
(45) Date of Patent: May 21, 2019

(54) STRINGED MUSICAL INSTRUMENT

(71) Applicant: LLEVINAC, S.L., Barcelona (ES)

(72) Inventor: Jordi Canivell Grifols, Barcelona (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 15/867,160

(22) Filed: Jan. 10, 2018

(65) Prior Publication Data

US 2018/0197511 A1 Jul. 12, 2018

(30) Foreign Application Priority Data

Jan. 12, 2017 (ES) ..... 201730028

(51) Int. Cl.

| | |
|---|---|
| ***G10D 3/06*** | (2006.01) |
| ***G10D 3/14*** | (2006.01) |
| ***G10D 1/08*** | (2006.01) |

(52) U.S. Cl.

CPC ..... *G10D 3/06* (2013.01); *G10D 1/08* (2013.01); *G10D 3/14* (2013.01)

(58) Field of Classification Search

CPC ..... G10D 3/14; G10D 1/08; G10D 3/06
See application file for complete search history.

(56) References Cited

U.S. PATENT DOCUMENTS

| | | | | |
|---|---|---|---|---|
| 5,353,672 | A * | 10/1994 | Stewart | G10D 3/06 84/267 |
| 6,265,648 | B1 | 7/2001 | Steinberger | |
| 7,687,698 | B2 | 3/2010 | Kim | |
| 7,875,782 | B1 | 1/2011 | Nechville | |
| 2001/0010186 | A1 | 8/2001 | Steinberger | |
| 2011/0226113 | A1 | 9/2011 | Zervas et al. | |
| 2013/0042740 | A1 | 2/2013 | Denton | |
| 2016/0027415 | A1 | 1/2016 | Hooker | |
| 2016/0293145 | A1 | 10/2016 | Chapman et al. | |

FOREIGN PATENT DOCUMENTS

| | | | |
|---|---|---|---|
| WO | 2010070363 | A1 | 6/2010 |
| WO | 2011/098347 | A1 | 8/2011 |

OTHER PUBLICATIONS

Spanish Search Report dated Apr. 25, 2017 for Application No. 201730062 in 4 pages.
Extended European Search Report for Application No. 18382007 in 9 pages.

* cited by examiner

*Primary Examiner* — Kimberly R Lockett
(74) *Attorney, Agent, or Firm* — Knobbe, Martens, Olson & Bear, LLP

(57) ABSTRACT

A stringed musical instrument includes a mechanism for adjusting and setting the angular position of the neck with respect to the instrument body. The mechanism includes a metal projection secured in a metal insert arranged inside the neck coupling portion, and additionally a metal piece that defines a groove for receiving the metal projection. The metal piece is partially inserted into the instrument body coupling portion. The projection and the groove fit together and are aligned with one another without there being any contact between them. The, groove has sufficient clearance for allowing variation of the angular position of the neck with respect to the instrument body by displacement of the projection along the groove.

9 Claims, 6 Drawing Sheets

STRINGED MUSICAL INSTRUMENT

FIELD OF THE INVENTION

The present invention relates to the field of stringed musical instruments, for example guitars, among others.

In particular, the present invention relates to a stringed musical instrument of the type comprising an instrument body, a neck and a pegbox, the neck and the instrument body being coupled together by respective coupling portions that fit together, said neck and body coupling portions being secured by means of at least one main bolt inserted through a hole that is common to said coupling portions, said musical instrument comprising a mechanism for adjusting the angular position of said neck with respect to said instrument body.

BACKGROUND OF THE INVENTION

In the music industry, musicians increasingly require musical instruments that can be personalised and that can be adapted to the way in which the musicians play said instruments. In many cases, musical instruments such as guitars are custom-made at the express request of the musicians. In some instances, the musicians ask for certain guitar parts to be replaced in order to experience new sounds and/or in order to better adapt to their playing style. However, custom-made musical instruments are expensive and not every musician can afford them.

On the other hand, guitars that are available on the market do not provide the possibility for some parts to be exchanged for others. For example, the neck of the guitar cannot generally be replaced, due to the dimensional instability of the wood of the neck, among other reasons. For this reason, there are mechanisms that make it possible to adjust the angular position of the neck of the guitar with respect to the body thereof. For example, the Spanish patent application document ES2578268A1 discloses a device which comprises two mating toothed surfaces, one being attached to the neck and the other being attached to the guitar body, and both being pressed together by means of a bolt. The device allows the user to modify the inclination of the neck with respect to the body of the guitar, adopting discrete inclinations that are determined by the geometry of said toothing. Given that the sound of the instrument, which is generally made of wood, is significantly affected by substantial variations in the inclination of the neck, the lack of versatility of the predetermined positions on account of the geometry of the toothing makes it impossible to vary the angular position of the neck into all angles, and therefore the instrument is not suitable for the needs of every musician.

SUMMARY OF THE INVENTION

The present invention aims to solve the aforementioned problems of the prior art and to disclose a stringed musical instrument which comprises a mechanism for adjusting and subsequently setting the angular position of the neck with respect to the instrument body and which provides improved adjustment and setting with respect to the systems of the prior art.

In particular, the present invention discloses a stringed musical instrument according to main claim 1. Said stringed musical instrument, preferably a guitar among others, is of the type that comprises an instrument body, a neck and a pegbox, the neck and the instrument body being coupled by respective coupling portions that fit together and said neck and body coupling portions being secured by means of at least one main bolt inserted through a hole that is common to both coupling portions. Said stringed musical instrument additionally comprises a mechanism for adjusting and setting the angular position of said neck with respect to said instrument body, which mechanism is characterised in that it comprises a metal projection secured in a metal insert arranged inside the neck coupling portion, and a metal piece that defines a groove for receiving said metal projection, said metal piece being partially inserted into the instrument body coupling portion, said projection and said groove fitting together and being aligned with one another but without there being any contact therebetween, and said groove additionally having sufficient clearance for allowing variation of the angular position of the neck with respect to the instrument body by means of displacement of the projection along said groove.

Firstly, the metal projection may act as a guide along the clearance of the groove in the metal piece, making it possible to ensure efficient alignment between the respective neck and instrument body coupling portions, which comprise said projection and said groove, respectively. Likewise, the structure of the projection fitted together with the groove makes it possible to continuously adjust or vary the relative position between the neck and the instrument body by means of precise and fine adjustment.

Secondly, because the set of components involved in the adjusting and setting mechanism of the present invention are made of metal, the clamping action of the main bolt means the mechanism can be reinforced in its setting position against the vibrations produced during use of the musical instrument itself. Since the respective coupling portions of the neck and the body comprise metal components that are secured in a determined position by means of the clamping action of the main bolt, which is inserted through holes that are common to said metal components, the setting mechanism is reinforced against said vibrations.

Furthermore, because the set of components involved in the adjusting and setting mechanism of the present invention are made of metal, it is possible to exchange different necks on the same body of a musical instrument in a quick, convenient and efficient manner.

Additionally, the metal projection and the metal piece which comprises the groove along which said projection can slide in order to allow continuous variation of the angular position of the neck with respect to the instrument body never come into contact during actuation of the adjusting mechanism, and only the respective coupling portions of the neck and the body, which are usually made of wood, are in contact, the wood being the essence of the sound of a guitar.

Preferably, the neck coupling portion and the metal projection inserted therein are convex and the instrument body coupling portion and the metal piece that comprises the groove are concave, such that the centre of rotation of the angular position of the neck with respect to the instrument body coincides with the plane defined by the strings once arranged on said musical instrument. In this way, the pressure of the strings on the adjusting mechanism according to the present invention does not need to be maintained.

Preferably, both the metal projection and the metal piece each comprise an opening that coincides with the respective holes in the respective neck and body coupling portions, allowing access for said main bolt.

Preferably, said metal piece additionally comprises a recess having an auxiliary bolt, which comprises a ball-like end that acts as a variable stop for said projection and comprises an actuation head for varying the position of said auxiliary bolt. Optionally, the auxiliary bolt makes it possible to finely adjust the inclination or vary the relative position between the neck and the body of the guitar. Furthermore, said auxiliary bolt also provides the mechanism according to the present invention with reinforcement and additional stability against the vibrations caused by the strings during use of the stringed musical instrument. More preferably, the instrument body comprises a hole for accessing the head of said auxiliary bolt, making it possible to actuate said bolt by means of an Allen key or the like.

Preferably, the metal projection is attached to said metal insert by means of at least one bolt inserted through a hole that is common to said projection and to said insert but that is different from the hole in the main bolt.

Preferably, the hole arranged in the neck through which the main bolt is inserted is of the threaded type.

BRIEF DESCRIPTION OF THE DRAWINGS

To aid understanding, explanatory yet non-limiting drawings of an embodiment of the subject matter of the present invention are included.

DETAILED DESCRIPTION OF THE PREFERRED EMBODIMENTS

Figure 1:
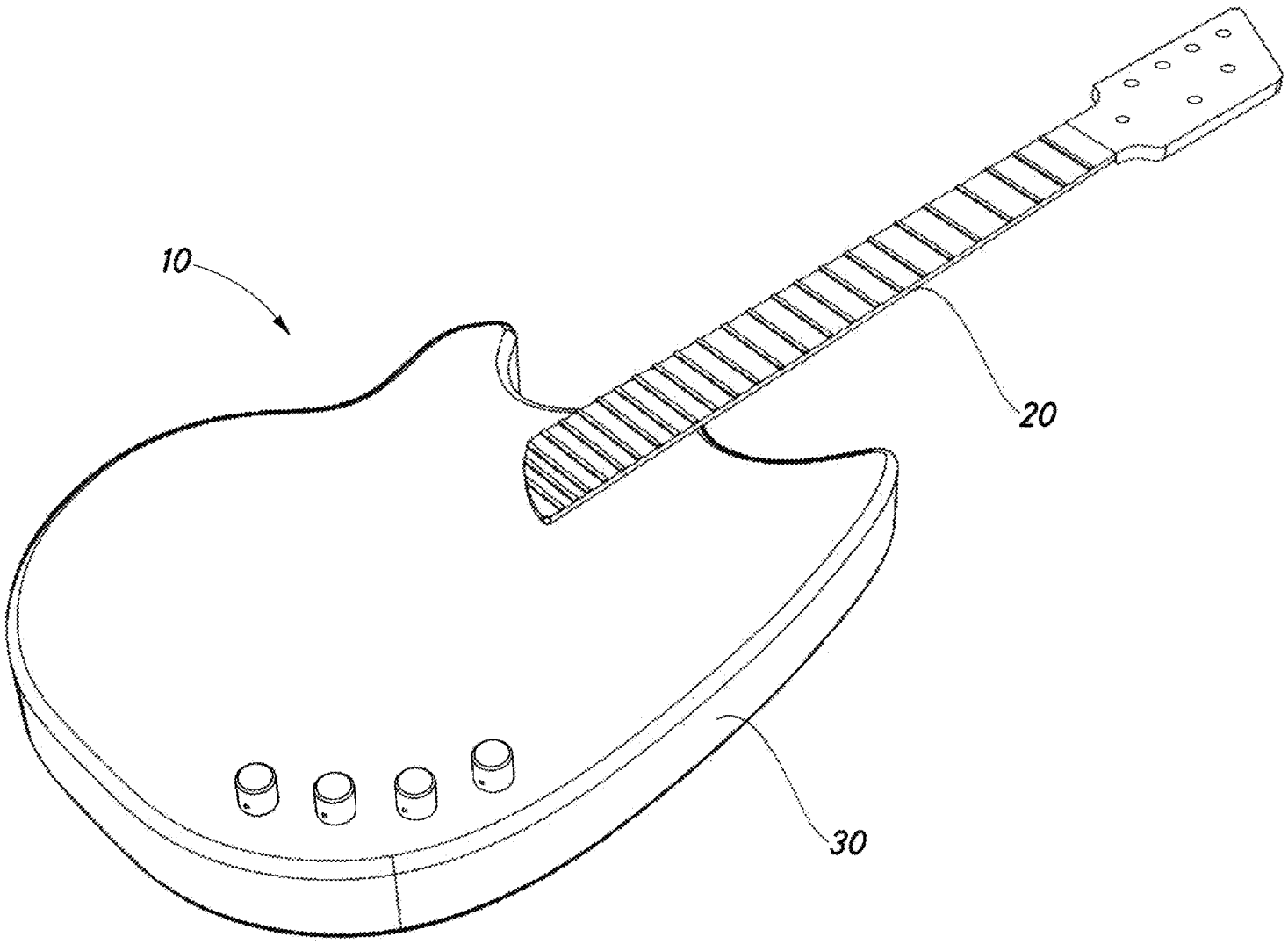
FIG. 1 is a perspective view of a stringed musical instrument, in this case a guitar, which comprises a mechanism for adjusting and setting the angular position of the neck with respect to the body of said guitar according to the present invention.
Figure 2:
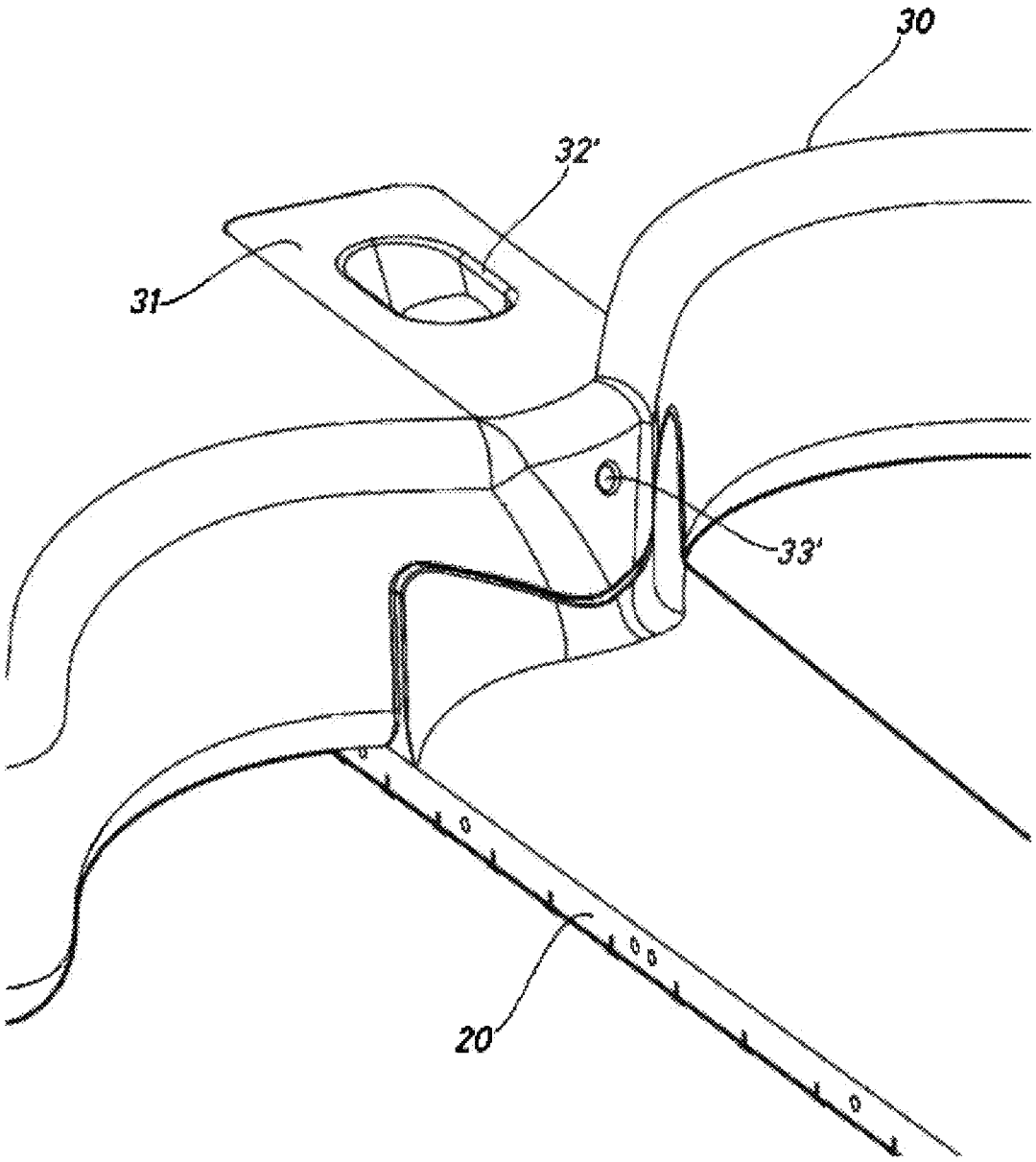
FIG. 2 is a perspective view of a detail of the rear portion of the guitar from FIG. 1.

The embodiment in FIG. 1 shows a guitar -10- comprising a neck -20- coupled to a body -30- by means of respective coupling portions (-200-, -300-) (see FIGS. 3 to 6) of the neck -20- and the body -30- that fit together and comprise an adjusting and setting mechanism according to the present invention. As will be seen below, said respective neck -20- and body -30- coupling portions (-200-, -300-) comprise respective surfaces (-210-, -220-) (-310-, -320-) for contact between said coupling portions (-200-, -300-). The body -30- of the guitar -10- comprises (see FIG. 2) a metal piece -31- for receiving a metal projection -21- (see FIG. 4). The metal receiving piece -31- comprises an opening -32'- (see FIGS. 2 and 3) which, as will be explained in detail below, allows insertion of a main bolt -32-, the head -32"- of said main bolt -32- being visible through the lower portion of the guitar -10- (see FIG. 2). Additionally, the coupling portion -200- of the neck -20- and the metal projection -21- inserted therein are convex, and the coupling portion -300- of the body -30- and the metal piece -31- that comprises the groove -34- are concave, such that the centre of rotation of the angular position of the neck -20- with respect to the body -30- coincides with the plane defined by the strings once arranged on the neck -20- of the guitar -10-. In this way, the pressure of the strings on the adjusting and setting mechanism according to the invention does not need to be maintained.

Figure 3:
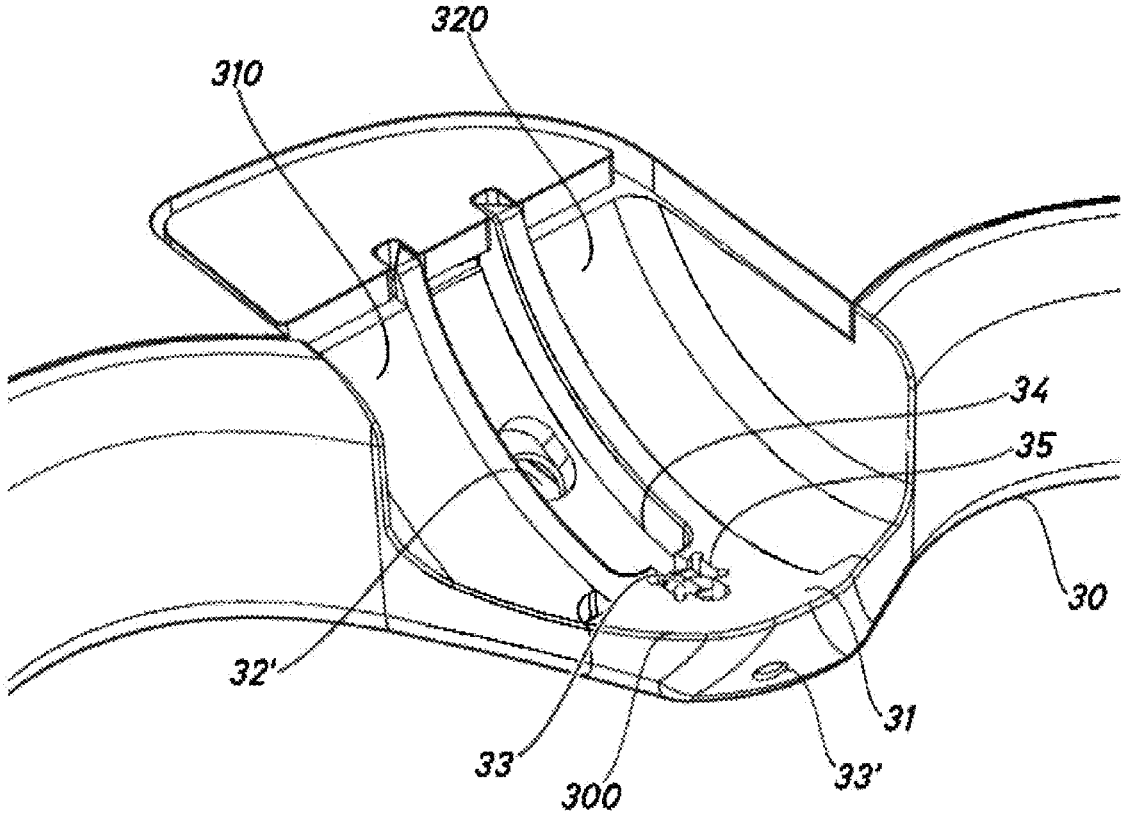
FIG. 3 is a perspective view of a detail of the body of the guitar from FIG. 1, showing the metal piece which defines a groove for receiving said metal projection.
Figure 4:
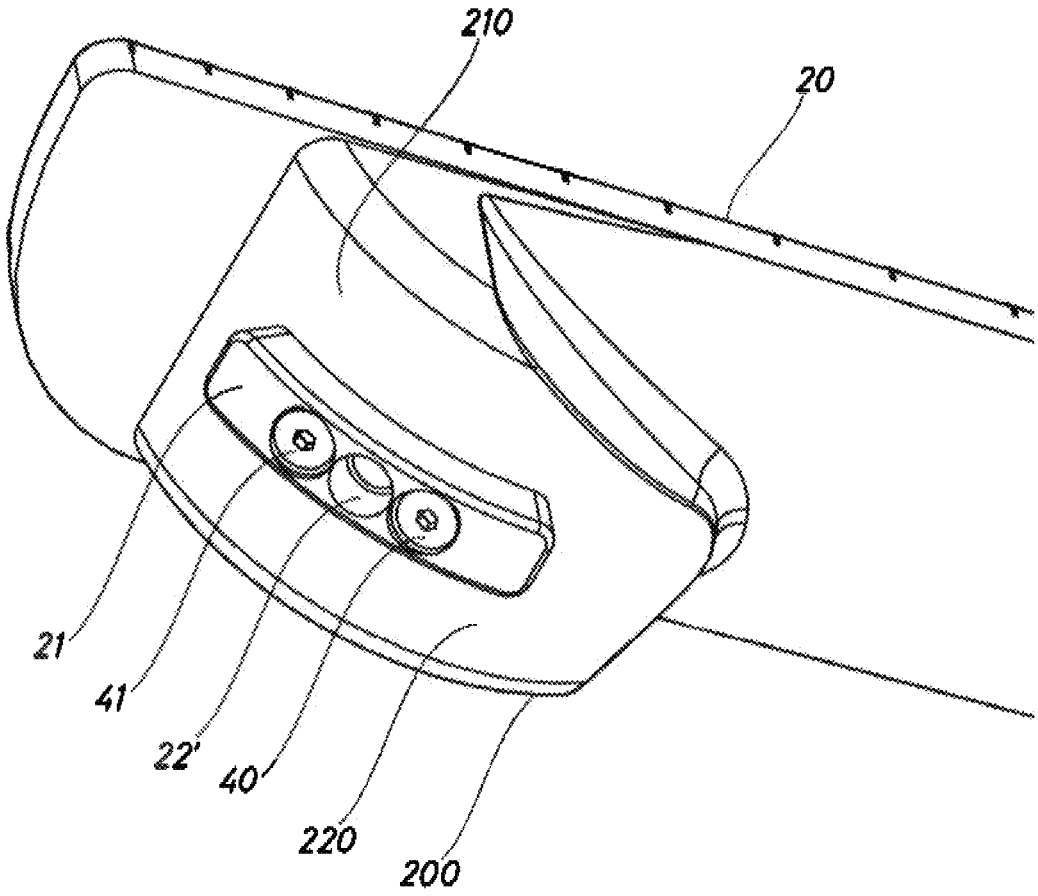
FIG. 4 is a perspective view of a detail of the neck of the guitar from FIG. 1, in which the metal projection of the neck is shown.
Figure 5:
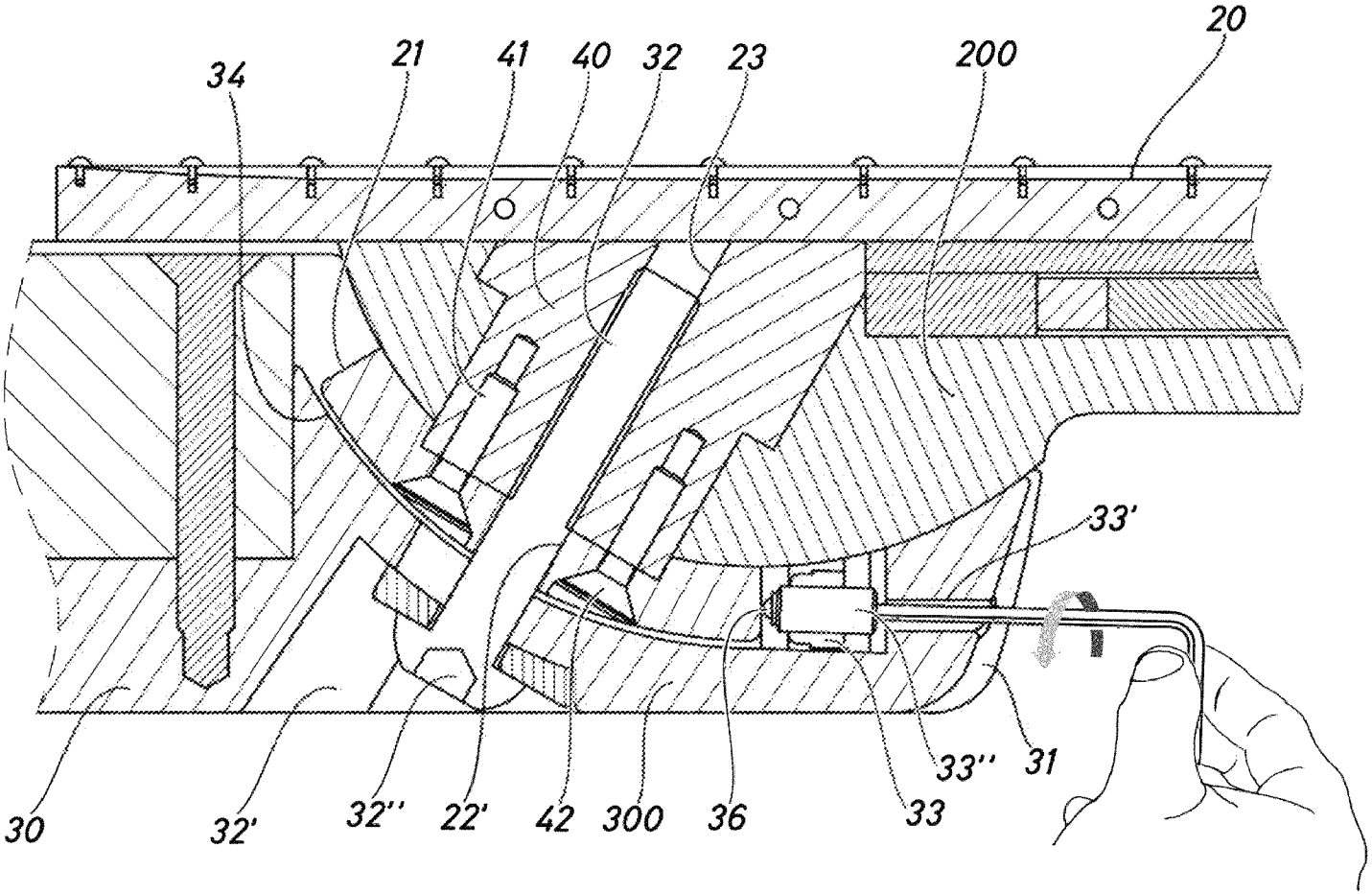
FIGS. 5 and 6 show two longitudinal sections through the longitudinal axis of the neck, a different angular position between the neck and the guitar body being shown in each of the figures.
Figure 6:
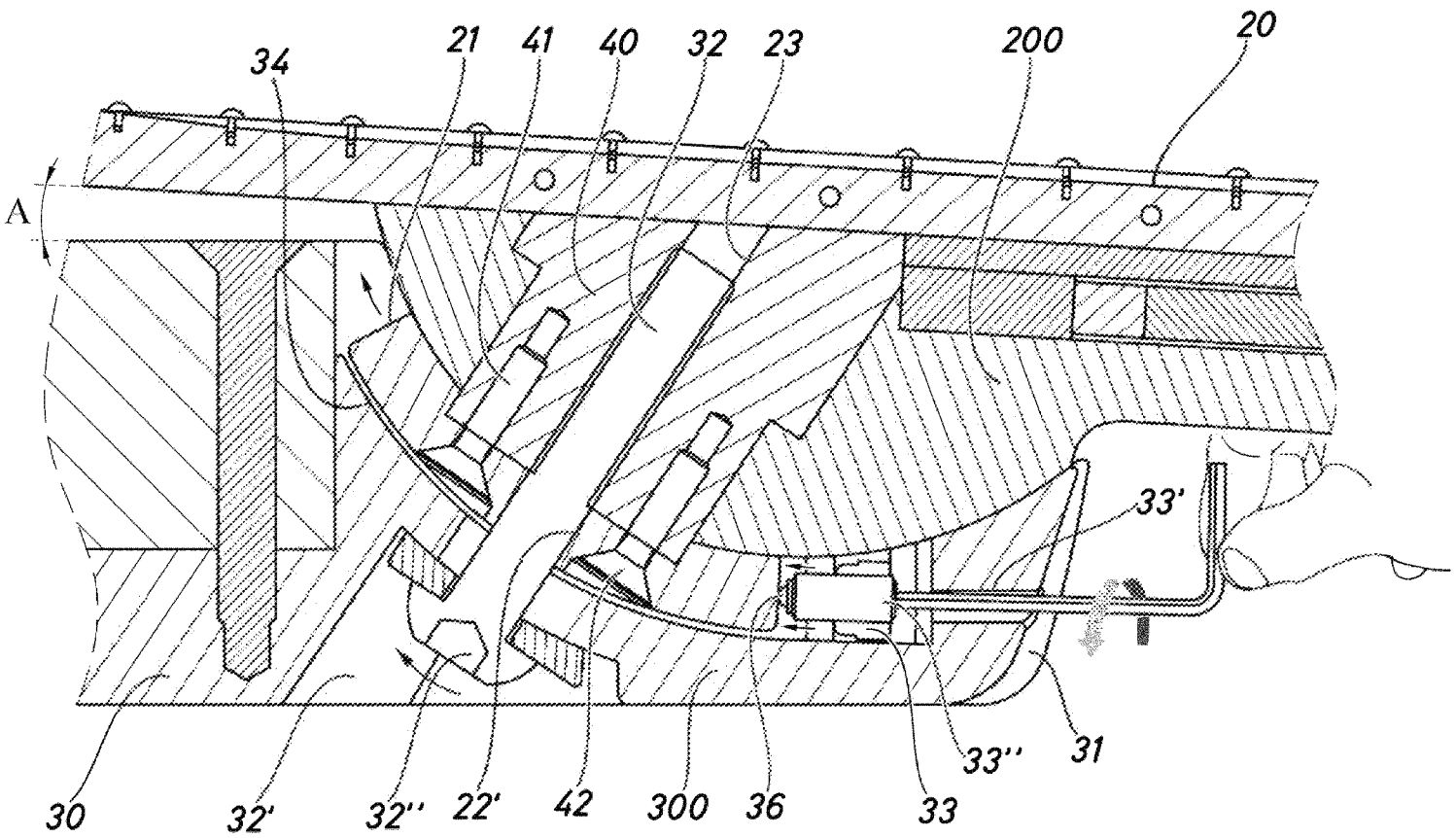

As can be seen in FIG. 3, the metal receiving piece -31- may optionally comprise a recess -35- that has a threaded surface and in which there is arranged a self-locking nut -33-, through the inner threaded hole in which an auxiliary bolt -33"- is arranged (see FIG. 5 or 6); as will be explained below, this auxiliary bolt may either act as a variable stop for said metal projection -21- or may allow fine adjustment of the relative position between the body -30- and the neck -20- of the guitar -10-. As can be seen in FIG. 5 or 6, said receiving piece -31- allows the user to access the auxiliary bolt -33"- via an auxiliary hole -33'- (see also FIGS. 2, 5 and 6), thus reaching the head (not shown) of said auxiliary bolt -33"-, which head has a shape capable of receiving an Allen key or the like, making it possible to vary the position of said auxiliary bolt -33"-. Additionally, said self-locking nut -33- may comprise a nylon insert that acts as a brake (not shown), preventing the auxiliary bolt -33"- from moving or loosening due to the vibrations produced during use of the guitar -10-.

Moreover, the projection -21- (see FIG. 4) comprises a second opening -22'- which also allows for the insertion of said main bolt -32- into a threaded hole -23- that is arranged in the neck -20- (see FIG. 5 or 6) and coincides with said second opening -22'-. In this way, when the projection -21- is in a position facing the receiving piece -31-, the main bolt -32- can pass through both the opening -32'- in the piece -31- and the opening -22'- in the projection -21- so as to be inserted into the threaded hole -23- (see FIG. 5 or 6) in the neck -20- and, in this way, set an angular position of the neck -20- with respect to the body -30- of the guitar -10- by means of the respective surfaces (-210-, -220-) (-310-, -320-) thereof for contact between said coupling portions (-200-, -300-) of the neck -20- and body -30-, respectively. As a result, the clamping action of the main bolt -32- presses the surfaces (-210-, -220-) of the coupling portion -200- of the neck -20- against the surfaces (-310-, -320-) of the coupling portion -300- of the body -30-, causing the projection -21- to face the receiving piece -31- without there being any contact therebetween, thus setting the angular position of the neck -20- with respect to the body -30- of the guitar -10-.

As can be seen in FIG. 3, the piece -31- for receiving the projection -21- comprises a groove -34- intended to receive said projection -21-. Said projection -21- and said groove -34- have a matching shape and are aligned with one another but without there being any contact therebetween, as can be seen in FIGS. 3 to 6. Additionally, said groove -34- has sufficient clearance for allowing variation of the angular position of the neck -20- with respect to the body -30- of the guitar -10- by means of displacement of the projection -21- along said groove -34-. In this way, the projection -21- may act as a guide along the clearance of the groove -34- in the receiving piece -31-, in turn making it possible to ensure efficient alignment between the respective coupling portions (-200-, -300-) of the neck -20- and body -30-, which comprise said projection -21- and said groove -34-, respectively. Likewise, the structure of the projection -21- fitted together with the groove -34- makes it possible to continuously adjust or vary the relative position between the neck -20- and the instrument body -30- by means of precise and fine adjustment, instead of passing from one determined position to another in an abrupt manner or by discrete inclinations.

The main bolt -32- (see FIGS. 5 and 6) allows the projection -21- to be held in an angular position with respect to the groove -34- in the piece -31- owing to the clamping action of the main bolt -32- pressing the surfaces (-210-, -220-) of the coupling portion -200- of the neck -20- against the surfaces (-310-, -320-) of the coupling portion -300- of the body -30-, thus setting the angular position of the neck -20- with respect to the body -30- of the guitar -10-.

In order to vary the angular position of the neck -20- with respect to the body -30- of the guitar -10-, firstly the main bolt -32- must be loosened and then the neck must be positioned in the desired angular position with respect to the body -30- permitted by the size of the clearance of the groove -34-. Said angular positioning of the neck -20- with respect to the body -30- can be carried out either manually or by acting on the auxiliary bolt -33"-.

In order to adjust the angular position of the neck -20- with respect to the body -30- of the guitar -10- by acting on the auxiliary bolt -33"-, firstly said main bolt -32- is loosened and then the auxiliary bolt -33"- is acted upon, the end of which comprises a ball -36- which comes into contact with the projection -21- (see FIGS. 5 and 6). By acting on said auxiliary bolt -33"-, the ball -36- pushes on the projection -21-, which slides along the groove -34- such that the angular position of the neck -20- with respect to the body -30- varies continuously and by means of a fine adjustment. Subsequently, by tightening the main bolt -32- once more, the relative position produced between the neck -20- and the body -30- of the guitar -10- can be set.

As can be seen in FIGS. 5 and 6, the metal projection -21- is secured by means of respective bolts (-41-, -42-) in a metal insert -40- arranged inside the neck coupling portion -200-. In this way, because the set of components involved in the adjusting and setting mechanism of the present invention are made of metal, it is possible to reinforce the mechanism itself in its setting position against the vibrations produced during use of the guitar -10- itself by means of the clamping action of the main bolt -32-. Since the coupling portions (-200-, -300-) of the neck -20- and body -30-, respectively, comprise metal components that are secured in a determined position by means of the clamping action of the main bolt -32-, which is inserted through holes that are common to said metal components, the setting mechanism is reinforced against said vibrations.

FIGS. 5 and 6 show two different positions of the neck -20- in relation to the body -30- of the guitar -10-, the neck -20- from FIG. 6 being inclined at a particular angle -A- with respect to the position shown in FIG. 5. As can be seen, the main bolt -32- rotates conjointly with the projection -21- with respect to the receiving piece -31-.

Although the invention has been set out and described with reference to embodiments thereof, it should be understood that these do not limit the invention, and that it is possible to alter many structural or other details that may prove obvious to persons skilled in the art after interpreting the subject matter disclosed in the present description, claims and drawings. Therefore, the scope of the present invention includes any variant or equivalent that could be considered covered by the broadest scope of the following claims.

What is claimed is:

1. A stringed musical instrument comprising:

an instrument body having an instrument body coupling portion, a neck having a neck coupling portion, and a pegbox, a mechanism, which comprises:

a metal projection secured in a metal insert arranged inside the neck coupling portion, and a metal piece that defines a groove adapted to receive said metal projection, said metal piece being partially inserted into the instrument body coupling portion, wherein the mechanism is configured to adjust and set an angular position of said neck with respect to said instrument body;

wherein:

the neck and the instrument body are coupled together by fitting the respective coupling portions together, said neck and body coupling portions are secured by at least one main bolt inserted through holes that communicate each other and run through the neck coupling portion and the instrument body coupling portion, and, said projection and said groove are aligned with one another but without contacting therebetween, said groove having sufficient clearance for allowing variation of the angular position of the neck with respect to the instrument body by displacement of the projection along said groove.

2. The stringed musical instrument according to claim 1, wherein the neck coupling portion and the metal projection inserted therein comprise a convex portion and the instrument body coupling portion and the metal piece that defines the groove, comprise a concave portion, such that a centre of rotation of the angular position of the neck with respect to the instrument body coincides with the plane defined by the strings once arranged on said musical instrument.

3. The stringed musical instrument according to claim 1, wherein both the metal projection and the metal piece each comprise an opening that communicate with the respective holes in the respective neck and body coupling portions, allowing access for said main bolt.

4. The stringed musical instrument according to claim 1, wherein said metal piece further comprises a recess having an auxiliary bolt, which comprises a ball-like end that adapted to be a variable stop for said metal projection and comprises an actuation head for varying the position of said auxiliary bolt.

5. The stringed musical instrument according to claim 4, wherein the instrument body comprises an access hole for accessing the head of said auxiliary bolt, so as to actuate said bolt by a tool.

6. The stringed musical instrument according to claim 1, wherein the metal projection is attached to said metal insert by at least one bolt inserted through at least one insert hole that runs through said metal projection and said metal insert.

7. The stringed musical instrument according to claim 1, wherein the hole arranged in the neck through which the main bolt is inserted is threaded.

8. The stringed musical instrument according to claim 1, wherein the instrument is a guitar.

9. The stringed musical instrument according to claim 5, wherein the tool is an Allen key.

* * * * *